United States Patent [19]

McCrary

[11] Patent Number: 4,617,736

[45] Date of Patent: Oct. 21, 1986

[54] SWIVEL HEADED SCRAPING DEVICE

[76] Inventor: Mark W. McCrary, Rte. 3, Box 25, Waxahachie, Tex. 75165

[21] Appl. No.: 637,038

[22] Filed: Aug. 2, 1984

[51] Int. Cl.[4] ..... B26B 3/00

[52] U.S. Cl. ..... 30/169; 30/89

[58] Field of Search ..... 30/169, 172, 89, 136, 30/136.5; 15/236 R; 17/19; 403/78, 164, 165

[56] References Cited

U.S. PATENT DOCUMENTS

| | | | |
|---|---|---|---|
| 713,979 | 11/1902 | Galipeau | 30/169 X |
| 1,518,100 | 12/1924 | Nighbert | 30/86 U X |
| 2,033,307 | 3/1936 | Schuster | 30/89 |
| 3,865,437 | 2/1975 | Crosby | 403/165 X |

FOREIGN PATENT DOCUMENTS

| | | | |
|---|---|---|---|
| 2730180 | 1/1979 | Fed. Rep. of Germany | 30/169 |

*Primary Examiner*—Douglas D. Watts

*Attorney, Agent, or Firm*—Richards, Harris, Medlock & Andrews

[57] ABSTRACT

A hand held scraping device has a rotatable head mounted on a handle; said head rotates about an axis substantially collinear with the elongate axis of said handle, has means to frictionally engage a razor blade, or other scraping spade, and has means for allowing the sharp edge of the razor to be exposed beyond the head; said handle has a razor storage housing mounted on it to provide a storage place for spare razor blades, and a cutout to facilitate the user's gripping of the invention and to conserve materials.

1 Claim, 5 Drawing Figures

SWIVEL HEADED SCRAPING DEVICE

TECHNICAL FIELD

The present invention relates to hand held scraping devices, and more particularly to a hand held scraping device having a scraping edge mounted on a rotatable head assembly.

BACKGROUND ART

As normally used for scraping, a straight edge razor blade is held between the fingers and is moved on a surface to remove paint or other debris. This use of a straight edge razor blade is inefficient, tiring, and dangerous. A razor blade is difficult to control when held in the hand, and this use quickly fatigues the user's hand and wrist. When the user's hand becomes fatigued serious injuries can result if the user's grip on the razor blade slips. In addition to the above disadvantages, the operator's fingers become slippery with natural oil and sweat after such use of a razor blade, aggravating the above disadvantages.

The prior art includes hand held scraping devices to be used on a flat surface and having a razor cutting edge or other scraping spade mounted in a head. Certain of these devices, such as U.S. Pat. No. 835,160 to Lutz et al. and U.S. Pat. No. 3,436,823 to Lamb et al., contemplate the rotation of the head, which holds the cutting edge, about an axis which is substantially perpendicular to the elongate axis of the handle. The substantially perpendicular axis of rotation of these devices necessarily limits the useful rotation that may be achieved.

In addition, the prior art includes deburring tools having a cutting edge extending perpendicularly from the end of a handle and rotating about an axis substantially collinear with the axis of the handle. These deburring tools, such as the one shown in U.S. Pat. No. 2,598,443 to Roth, are not intended to be used on flat surfaces, but are to be used to remove flash and other excess metal from fresh castings.

SUMMARY OF THE INVENTION

This invention comprises a device that grips a razor blade so it can be used to scrape paint or other debris from a flat surface, and provides a handle attached to said gripping device for an operator to hold, allowing an easy, efficient, and safe use of a razor blade, or other scraping edge, on a flat surface. The gripping device is attached for rotation with respect to the handle about an axis substantially collinear with the elongate axis of the handle. In addition, this invention provides a storage area for new or used razor blades in the handle.

BRIEF DESCRIPTION OF THE DRAWINGS

A more complete understanding of the invention and its advantages will be apparent from the detailed description taken in conjunction with the accompanying drawings in which.

Figure 2A:
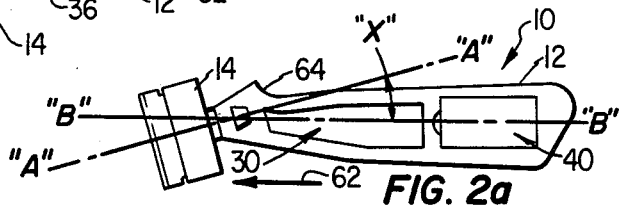
FIG. 2 is a partially broken away side view of the scraping device.
Figure 2:
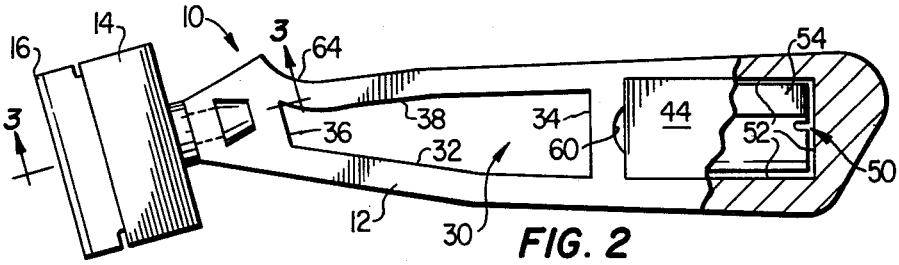
Figure 3:
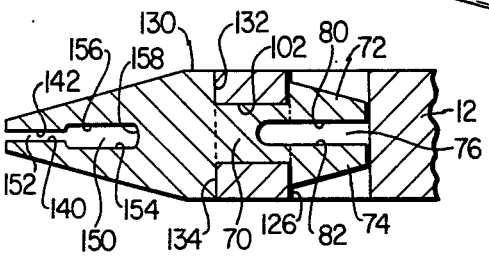
Figure 4:
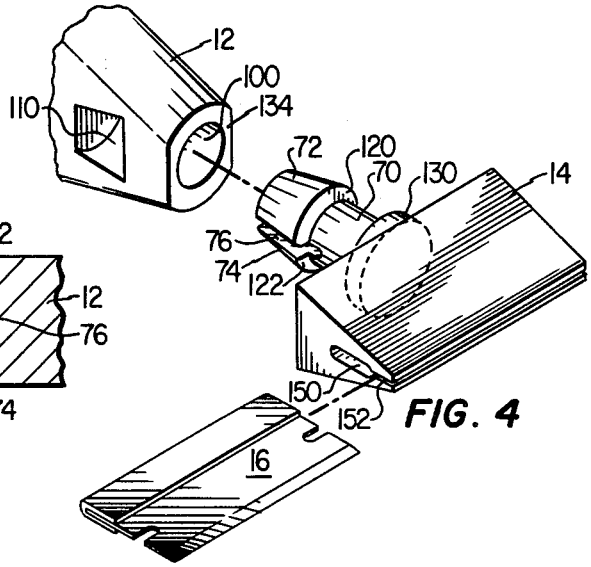

FIG. *2a* is a side view of the scraping device;

FIG. 3 a partial sectional view of the scraping device taken along line 3—3 in FIG. 2; and FIG. 4 is an exploded partial perspective view of the scraping device.

DETAILED DESCRIPTION

Figure 1:
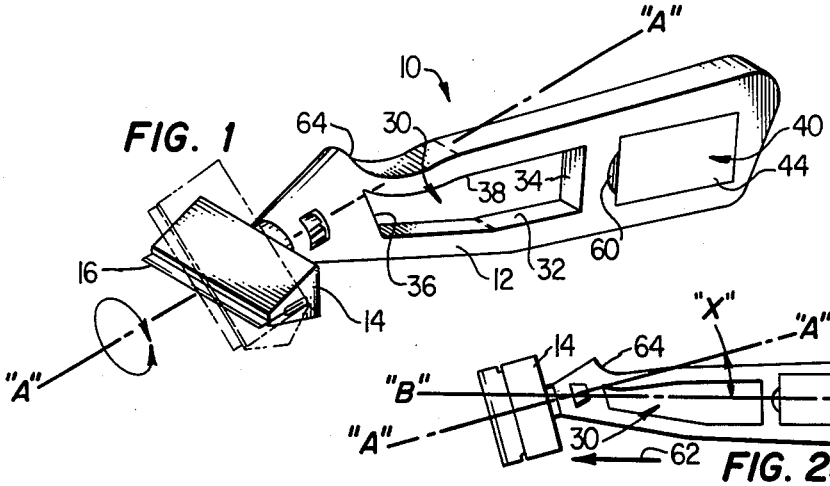
FIG. 1 is a perspective view of the scraping device.

Referring initially to FIGS. 1 and 2, the swivel headed scraping device 10 includes a handle 12 connected to a head 14. Head 14 is adapted to receive and firmly hold razor blade 16. Head 14 is rotatably attached to handle 12, such that it rotates freely about axis A—A. Handle 12 has cutout portion 30 to facilitate gripping of the handle and to reduce the amount of material used in manufacturing the device. Cutout portion 30 is defined by walls 32, 34, 36, and 38. Razor blade receiving and storing housing 40 is located in handle 12, and has cover 44 which is removably fitted to said handle. Said housing comprises opening 50 defined by walls 52 and is sized to accommodate a spare razor blade or blades 54. Notch 60 allows the user to engage and remove cover 44 with his fingertip. Handle 12 has concave shoulder 64 proximate to head 14. Said shoulder is of the approximate size and shape of the anticipated user's thumb and frictionally engages with said thumb to allow said user to exert an axial force on head 12 and razor 16 while using the invention.

Referring now to FIG. *2a*, head 14 is rotatably attached to handle 12 and rotates about axis A—A. Axis A—A is substantially collinear with the elongate axis B—B of handle 12. Axis B—B is parallel to the forward direction of scraping illustrated by arrow 62. Axis A—A forms angle x with Axis B—B. Angle x is less than about 30° but greater than about 5°. In the preferred embodiment, angle x is about 15°.

Referring now to FIGS. 3 and 4, head 14 includes barrel neck 70 having flange fingers 72 and 74. Flange fingers 72 and 74 are separated by notch 76. Notch 76 is defined by opposed planar walls 80 and 82 joined by end wall 84.

Barrel neck 70 fits into handle 12 by way of receiving channel 100 defined by cylindrical wall 102. Head 14 is manufactured from a resilient material, polypropylene being preferred, such that notch 76 between flange fingers 72 and 74 elastically deforms allowing said flange fingers to become spaced more closely while passing through channel 110. The flanged portion of barrel neck 70 locks into port 110 after passing through channel 100 by expanding to fill the inner space of port 100. Planar flange surfaces 120 and 122 bear against interior surface 126 of port 110, retaining head 14 in handle 12. Barrel neck 70 is loosely retained by cylindrical wall 102 to allow head 14 to turn freely with respect to handle 12. Collar 130 around neck 70, proximate to head 14, and having a planar surface 132, abuts planar surface 134 on handle 12, and absorbs the axial forces generated by the normal use of the invention. Razor blade 16 is frictionally engaged by opposed surfaces 140 and 142, and by chamber 150 in head 14. Opposed surfaces 140 and 142 are separated by gap 152. Chamber 150 has opposed surfaces 154 and 156. In addition to being sized to frictionally engage standard single-edged razor blade 16 between surfaces 154 and 156, chamber 150 has surface 158, which surface is located to limit the travel of razor 16 permitting the cutting edge of said blade to be exposed.

In normal operation, scraping device 10 is held in the user's hand. Razor blade 16 is removed from housing 40 on handle 12 by the user inserting his finger into notch 60 and removing housing cover 44. The user then inserts razor blade 16 in scraper head 14, by sliding razor blade 16 into chamber 150 which frictionally engages said razor blade, allowing the edge of blade 16 to be exposed. The user then grasps the invention's handle around cutout 30. The invention can then be used in a sweeping manner to scrap paint and other foreign materials from a flat work surface, such as glass. The user need not rotate his wrist or his hand while using this invention because head 14 rotates about axis A—A through handle 12, which rotation permits razor blade 16 to be flat against the work surface at all times. In this manner, the invention can be used to make broad scraping strokes across the work surface.

For particularly difficult scraping jobs, the user grips handle 12, placing his thumb against shoulder 64. Said shoulder frictionally engages the user's thumb, serving as a platform from which the user can exert an extra axial force on head 14 and razor blade 16 to scrape obstinant material from the work surface. In this manner, the invention can be used to make short powerful scraping strokes without the user rotating his hand or wrist as the successive strokes cause the scraper to progress across the work surface.

In another embodiment, this invention can be used to scrape rust from a steel surface. A scraping spade is substituted for razor 16, said spade being of appropriate design to scrape rust from steel and to snugly fit in head 14. The user grasps handle 12 in his fingers and places his thumb against shoulder 64. The invention is then used in a manner as described above.

While certain embodiments of the present invention have been described in detail herein and shown in the accompanying drawings, it will be evident that various further modifications are possible without departing from the scope of the invention.

I claim:

1. A handheld scraping device comprising a handle, barrel neck, head, razor blade and razor housing;

said handle being large enough to be held in a human hand, having a cutout portion, and containing said razor housing sized to receive at least one razor blade;

said barrel head being attached to said head having a collar to abut said handle, a first flange finger and a second flange finger to nonremovably engage with said handle said barrel neck allowing said head to freely rotate about an A—A passing through said handle's elongate axis B—B at an angle less than about 30°, but greater than about 5°;

said head having a gap and chamber means to frictionally engage said razor blade so that said blade lies in a plane containing said axis of rotation A—A, and allowing the cutting edge of said razor blade to project beyond the outer edge of the head;

said handle, head, and barrel neck made of polypropylene; and said razor housing having room for five razor blades, having a cover which is removably engaged with said housing, and having a notch to allow the user to remove said cover with his finger tip.

* * * * *